US008697252B2

(12) United States Patent
Irie et al.

(10) Patent No.: US 8,697,252 B2
(45) Date of Patent: Apr. 15, 2014

(54) HIGH-STRENGTH HOT-DIP GALVANNEALED STEEL SHEET WITH SUPERIOR PHOSPHATABILITY

(75) Inventors: Hiroshi Irie, Kakogawa (JP); Takatoshi Yoshida, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 1121 days.

(21) Appl. No.: 12/520,105

(22) PCT Filed: Jan. 7, 2008

(86) PCT No.: PCT/JP2008/050021

§ 371 (c)(1),
(2), (4) Date: Jun. 19, 2009

(87) PCT Pub. No.: WO2008/093508

PCT Pub. Date: Aug. 7, 2008

(65) Prior Publication Data

US 2010/0040906 A1 Feb. 18, 2010

(30) Foreign Application Priority Data

Jan. 29, 2007 (JP) ..... 2007-018117

(51) Int. Cl.
*B32B 15/04* (2006.01)
*B32B 15/18* (2006.01)
*B32B 15/20* (2006.01)

(52) U.S. Cl.
USPC ..... 428/659; 428/682; 428/684

(58) Field of Classification Search
USPC ..... 428/659, 658, 682, 683, 684
See application file for complete search history.

(56) References Cited

U.S. PATENT DOCUMENTS

| | | | | |
|---|---|---|---|---|
| 6,699,590 | B2 * | 3/2004 | Takeda et al. | 428/629 |
| 2006/0269776 | A1 | 11/2006 | Tanaka et al. | |
| 2008/0023111 | A1 * | 1/2008 | Nakanishi et al. | 148/284 |
| 2008/0070060 | A1 * | 3/2008 | Suzuki et al. | 428/659 |
| 2010/0003541 | A1 * | 1/2010 | Futamura et al. | 428/659 |
| 2010/0304183 | A1 * | 12/2010 | Honda et al. | 428/659 |

FOREIGN PATENT DOCUMENTS

| | | | |
|---|---|---|---|
| CN | 1483090 | A | 3/2004 |
| EP | 1 354 970 | A1 | 10/2003 |
| EP | 1 634 975 | A1 | 3/2006 |
| JP | 55 122865 | | 9/1980 |
| JP | 2003 105493 | | 4/2003 |
| JP | 2004 204280 | | 7/2004 |
| JP | 2004-263271 | | 9/2004 |
| JP | 2004 315960 | | 11/2004 |
| JP | 2006 233333 | | 9/2006 |
| JP | 2007 270176 | | 10/2007 |
| WO | WO 2006/068169 | A1 | 6/2006 |

OTHER PUBLICATIONS

JP 2004-315960 English Machine Translation, Yukimoto et al, Nov. 2004.*
JP 2006-233333 English Machine Translation, Sep. 2006.*
U.S. Appl. No. 12/094,997, filed May 27, 2008, Futamura, et al.
Chinese Office Action issued Aug. 4, 2011, in Patent Application No. 200880002306.3 (with English-language translation).
Extended European Search Report issued Jul. 5, 2011, in Patent Application No. 08702902.1.
Louis Bordignon, et al., "Quality improvement of the galvanised strips by the oxidation/reduction process", Stahl Und Eisen/Revue De Metallurgie, vol. 101, No. 7-8, XP 001209080, 2004, pp. 27-34.
J. Mahieu, et al., "Galvanizing of AHSS: Influence of the Surface and Sub-surface of Si-, Al- and P-alloyed Trip-aided Steel after Intercritical Annealing", Materials Science & Technology (MS&T) AIST Process Metallurgy, Product Quality and Applications Proceedings, vol. I, XP 9149607, Sep. 26-29, 2004, pp. 847-857.
J. Mahieu, et al., "Galvanizability of High-Strength Steels for Automotive Applications", Metallurgical and Materials Transactions A, vol. 32A, XP 002480933, Nov. 2001, pp. 2905-2908.

* cited by examiner

*Primary Examiner* — Michael E La Villa
(74) *Attorney, Agent, or Firm* — Oblon, Spivak, McClelland, Maier & Neustadt, L.L.P.

(57) ABSTRACT

Disclosed is a hot-dip galvannealed steel sheet that stably exhibits satisfactory phosphatability. It is a high-strength hot-dip galvannealed steel sheet which includes a base steel sheet and, arranged on at least one side thereof, an Fe—Zn alloyed galvanized layer. The base steel sheet contains 0.03% to 0.3% of carbon, 0.5% to 3.0% of silicon, and 0.5% to 3.5% of manganese, with the remainder including iron and inevitable impurities. The Fe—Zn alloyed galvanized layer has a concentration of silicon present as an oxide of [Si] (percent by mass) and a concentration of manganese present as an oxide of [Mn] (percent by mass), and these parameters satisfy the following conditions (1) and (2):

$$[Si] \leq 0.25 \quad (1)$$

$$[Mn]/[Si] \leq 3.0 \quad (2).$$

10 Claims, No Drawings

HIGH-STRENGTH HOT-DIP GALVANNEALED STEEL SHEET WITH SUPERIOR PHOSPHATABILITY

TECHNICAL FIELD

The present invention relates to high-strength hot-dip galvannealed steel sheets that are used as steel sheets for automobile bodies. Specifically, it relates to high-strength hot-dip galvannealed steel sheets that excel in quality in phosphating (phosphatability) carried out as a surface treatment for coating (painting).

BACKGROUND ART

A hot-dip galvannealed steel sheet (hereinafter also briefly referred to as "GA steel sheet") is obtained by heating a hot-dip galvanized steel sheet (GI steel sheet) to allow iron in the base steel sheet to diffuse into a galvanized layer to thereby alloy iron and zinc (Zn). Such GA steel sheets excel typically in strength, weldability, and corrosion resistance after coating and are used typically as steel sheets for automobile bodies.

The GA steel sheets, when used for the above usage, are subjected to coating (painting), and, before coating, they are generally subjected to phosphating as a surface treatment for coating. It is important to deposit a satisfactory phosphate crystal coating as a result of the phosphating, for ensuring satisfactory coating properties such as coating adhesion and corrosion resistance.

GA steel sheets as intact are known to exhibit superior phosphatability. This is because the surface of the galvanized layer is composed of a Zn—Fe alloy having satisfactory reactivity with a phosphating agent and contains substantially no impurities.

On the other hand, high-tensile (high-strength) steel sheets have been widely used in automobile industries, in order to improve collision safety and to increase fuel efficiency as a result of weight reduction. For providing steel sheets with higher tensile, reinforcing elements such as Si, Al, Mn, P, Cr, Mo, and Ti are incorporated into base steel sheets. However, when a steel sheet containing these elements is used as a base steel sheet and subjected to hot-dip galvanizing and alloying (galvannealing), the respective elements diffuse with iron into a galvanized layer during alloying process after galvanization and are contained as impurities in the galvanized layer. The resulting GA steel sheet suffers from instable phosphatability due to the added elements contained during galvanization, although such a GA steel sheet, if not containing these elements, exhibits satisfactory phosphatability.

In this connection, Si and Mn are mainly used as reinforcing elements for the production of a high-tensile steel sheet. Upon galvanization of the surface of a steel sheet containing these elements, an effective method for preventing generation of bare spots and for stably ensuring satisfactory appearance quality is a method of oxidizing the surface of the steel sheet, carrying out annealing in a hydrogen-containing atmosphere (reduction annealing), and subsequently carrying out galvanization (hereinafter this method is also referred to as "oxidation-reduction galvanizing method") (for example, Patent Document 1).

In the oxidation-reduction galvanizing method, Si and Mn in the steel sheet are oxidized to form oxides simultaneously with the oxidization of iron during the oxidation process; but Si and Mn remain as oxides without being reduced in the subsequent reduction process, although iron is reduced in this process. The remained oxides are contaminated and dispersed with iron into a galvanized layer in the subsequent galvanizing/alloying process. Depending on the oxidation conditions, the magnitudes of the generations of silicon oxides and manganese oxides vary, and the amounts of these oxides dispersed into the galvanized layer also vary.

There are disclosed techniques relating to GA steel sheets containing oxides in the galvanized layer (Patent Documents 2 and 3). These techniques, however, fail to teach about the amounts of oxides in the galvanized layer, although they mention the presence of the oxides. The GA steel sheets disclosed in these documents are produced by carrying out acid pickling of the base steel sheet under controlled conditions before galvanization, and adjusting the partial pressures of water vapor and hydrogen in a reduction furnace, and this technique is fundamentally different from the oxidation-reduction galvanizing method. Additionally, these techniques are intended to improve deposit adhesion and alloying processability, respectively, but do not pay attention to phosphatability. Specifically, techniques for improving the phosphatability of a GA steel sheet containing oxides in its galvanized layer have not yet been established.

Patent Document 1: Japanese Unexamined Patent Application Publication (JP-A) No. 122865/1980

Patent Document 2: JP-A No. 204280/2004

Patent Document 3: JP-A No. 315960/2004

DISCLOSURE OF INVENTION

Problems to be Solved by the Invention

Under these circumstances, the present invention has been made and an object thereof is to provide a hot-dip galvannealed steel sheet that stably exhibits satisfactory phosphatability.

Means for Solving the Problems

According to the present invention to achieve the object, there is provided a hot-dip galvannealed steel sheet which is a high-strength hot-dip galvannealed steel sheet including a base steel sheet and, arranged on at least one side thereof, an Fe—Zn alloyed galvanized layer, in which the base steel sheet contains 0.03% to 0.3% ("%" means "percent by mass", hereinafter the same) of carbon (C), 0.5% to 3.0% of silicon (Si), and 0.5% to 3.5% of manganese (Mn), with the remainder including iron and inevitable impurities, and the Fe—Zn alloyed galvanized layer has a concentration of silicon present as an oxide of [Si] (percent by mass) and a concentration of manganese present as an oxide of [Mn] (percent by mass), and the parameters [Si] and [Mn] satisfy the following conditions (1) and (2):

$$[Si] \leq 0.25 \quad (1)$$

$$[Mn]/[Si] \leq 3.0 \quad (2)$$

In the hot-dip galvannealed steel sheet according to the present invention, it is preferred that (a) the alloyed galvanized layer has an aluminum (Al) content of 0.35% or more and/or (b) has an iron (Fe) concentration of from 7% to 15%. The base steel sheet for use in the present invention may be advantageously one further containing, in addition to the above-mentioned components, (c) 0.001% to 1.0% of chromium (Cr) and/or (d) 0.005% to 3.0% of aluminum (Al).

Advantages

According to the present invention, there are provided hot-dip galvannealed steel sheets with superior phosphatability, by suitably specifying the concentrations of Si and Mn present as oxides in the galvanized layer and suitably specifying the ratio between them. These hot-dip galvannealed steel sheets are useful as materials typically as steel sheets for automobile bodies.

BEST MODES FOR CARRYING OUT THE INVENTION

After intensive investigations to provide a GA steel sheet that exhibits satisfactory phosphatability, the present inventors obtained the following findings. Specifically, when the oxidation-reduction galvanizing method is basically employed, other elements than Si and Mn can be contaminated into the galvanized layer, but the phosphatability is most affected by oxides (silicon oxides, manganese oxides, and Si—Mn multi-component oxides) of Si and Mn as major reinforcing elements to be added in the base steel sheet, and satisfactory phosphatability is obtained by controlling the amounts of oxides of these elements within suitable ranges. In addition, the present inventors found that satisfactory phosphatability is exhibited by controlling the amounts of these oxides so as to satisfy the conditions (1) and (2). The present invention has been made based on these findings. Hereinafter the requirements or conditions specified in the present invention will be described.

In the GA steel sheet according to the present invention, when the Fe—Zn alloyed galvanized layer has a concentration of silicon present as an oxide [Si] (percent by mass), the parameter [Si] should satisfy the following condition (1):

$$[Si] \leq 0.25 \quad (1)$$

If the Si concentration [Si] is more than 0.25 (percent by mass), phosphate crystals become coarse to thereby impair the coating adhesion and increase surface roughness after coating, thus causing deteriorated appearance quality. Phosphate crystals become coarse when the Si concentration [Si] does not satisfy the condition (1), probably because, with an increasing Si concentration [Si], silicon oxides cover larger areas of the surface of the galvanized layer, and this inhibits the formation of crystal nucleus during phosphating.

In the GA steel sheet according to the present invention, when the Fe—Zn alloyed galvanized layer has a concentration of silicon present as an oxide [Si] (percent by mass) and a concentration of manganese present as an oxide of [Mn] (percent by mass), these parameters should satisfy the condition (2):

$$[Mn]/[Si] \leq 3.0 \quad (2)$$

With an increasing ratio ([Mn]/[Si]), the plane ratio (mentioned later) of phosphate crystals increases. If the ratio is more than 3.0, it is difficult to ensure satisfactory wet adhesion stably. The plane ratio of phosphate crystals increases with an increasing ratio ([Mn]/[Si]), probably because an oxide becomes more manganese-rich, and a film of such manganese-rich oxide is dissolved in a larger amount in a treating solution during phosphating, and this affects the deposition of phosphate crystals.

In the GA steel sheet according to the present invention, the object can be achieved by suitably specifying the concentration of silicon present as an oxide [Si] (percent by mass), the concentration of manganese present as an oxide [Mn] (percent by mass), and the ratio between these concentrations ([Mn]/[Si]). Additionally, the aluminum concentration and iron concentration of the galvanized layer are preferably controlled within suitable ranges.

Specifically, the aluminum concentration of the Fe—Zn alloyed galvanized layer is preferably 0.35% or more. When a GA steel sheet is produced according to the oxidation-reduction galvanizing method, it is effective to set a high aluminum concentration of the galvanized layer in order to stably prevent the generation of bare spots. Specifically, when a GA steel sheet is produced according to a common method of carrying out galvanization after reduction, the resulting galvanized layer has an aluminum concentration of about 0.15% to about 0.3%. In contrast, when a GA steel sheet is produced according to the oxidation-reduction galvanizing method, the surface of the base steel sheet is oxidized during the oxidation process to thereby prevent easily oxidizable elements such as Si and Mn from being enriched as oxides in the surface layer of the steel sheet during annealing process (reduction annealing) and to accelerate the reaction between the surface of the steel sheet and aluminum contained in a galvanized bath to thereby increase the aluminum concentration of the galvanized layer. Thus, generation of bare spots is stably inhibited. From these viewpoints, the aluminum concentration of the galvanized layer is preferably at least 0.35% or more, more preferably 0.40% or more, and furthermore preferably 0.45% or more.

However, the aluminum concentration is preferably 0.8% or less, and more preferably 0.7% or less, because the galvanized layer, if having an excessively high aluminum concentration, may become resistant to alloying after galvanization. The aluminum concentration of the galvanized layer can be increased by sufficiently oxidizing iron during the oxidation carried out before annealing and/or by increasing the aluminum concentration of the galvanization bath.

The iron concentration of the Fe—Zn alloyed galvanized layer is preferably from about 7% to about 15%. If the galvanized layer has an iron concentration of less than 7%, alloying may not sufficiently proceed and reach the surface of the galvanized layer, and this may result in surface appearance with metallic luster. If the galvanized layer has an iron concentration of more than 15%, the resulting steel sheet may show poor anti-powdering.

The Fe—Zn alloyed galvanized layer may further contain other components such as P, Cr, Ni, Mo, Ti, Cu, B, and C, and oxides of them, in addition to the above components Si, Mn, and Al.

The GA steel sheet according to the present invention includes a base steel sheet and, arranged on at least one side thereof, an Fe—Zn alloyed galvanized layer having the above configuration. In the GA steel sheet according to the present invention, though not especially limited, the mass of coating per unit area is preferably 30 g/m$^2$ or more, and more preferably 40 g/m$^2$ or more in consideration of ensuring corrosion resistance. It is preferably 70 g/m$^2$ or less, and more preferably 60 g/m$^2$ or less, because an excessive coating may cause significant powdering during working.

The base steel sheet for use in the present invention contains chemical components including 0.03% to 0.3% of carbon (C), 0.5% to 3.0% of silicon (Si), and 0.5% to 3.5% of manganese (Mn), with the remainder being iron and inevitable impurities. Reasons for specifying these components will be described below.

[Carbon (C): 0.03% to 0.3%]

Carbon (C) element is necessary for ensuring the strength of the steel sheet, and for exhibiting these advantages, the carbon content should be 0.03% or more and is preferably 0.05% or more. However, a steel sheet having an excessively high carbon content may be poor in weldability, and the carbon content should therefore be 0.3% or less and is preferably 0.25% or less.

[Silicon (Si): 0.5% to 3.0%]

Silicon (Si) element has high solid-solution strengthening capability to increase the strength of the steel sheet. To exhibit these advantages sufficiently, the silicon content should be 0.5% or more and is preferably 0.7% or more. However, a steel sheet having an excessively high silicon content may have an excessively high strength to thereby show an increased load during rolling, and, when subjected to hot rolling, the steel sheet may suffer from silicon scales to thereby impair the surface appearance and surface properties. Accordingly, the silicon content should be 3.0% or less and is preferably 2.5% or less.

[Manganese (Mn): 0.5% to 3.5%]

Manganese (Mn) element is effective for ensuring the strength of the steel sheet and is also effective for accelerating the generation of retained austenite to increase workability. To exhibit these advantages, the manganese content should be 0.5% or more and is preferably 1.0% or more. However, manganese, if contained in an excessively high content of more than 3.5%, may act to impair the ductility and weldability of the steel sheet. The manganese content is preferably 3.0% or less.

Preferred basic components of the base steel sheet are as mentioned above, with the remainder including iron and inevitable impurities. Exemplary inevitable impurities include P, S, and N.

Where necessary, the base steel sheet for use in the present invention may usefully further contain, in addition to the basic elements, for example, (c) 0.001% to 1.0% of chromium (Cr) and/or (d) 0.005% to 3.0% of aluminum (Al). In this case, the base steel sheet (namely, high-strength hot-dip galvannealed steel sheet) can have further improved properties according to the type of the component(s) to be contained. Preferred ranges of these elements, if contained, and reasons for specifying them are as follows.

[Chromium (Cr): 0.001% to 1.0%]

Chromium (Cr) element increases the hardenability of the steel sheet, accelerates the generation of martensite among low-temperature transformation phases, and effectively works to increase the strength of the steel sheet. For exhibiting these advantages, the chromium content is preferably 0.001% or more. However, these advantages may be saturated and higher cost may be caused when chromium is contained in an excessively high content, and the chromium content is therefore preferably 1.0% or less.

[Aluminum (Al): 0.005% to 3.0%]

Aluminum (Al) content is preferably 0.005% or more for satisfactory deoxidization. However, aluminum, if contained in an excessively high content, may cause embrittlement of the steel sheet and increased cost thereof, and the aluminum content is preferably 3.0% or less.

The GA steel sheet according to the present invention can be produced by adjusting oxidation/reduction conditions in an oxidation-reduction galvanizing method which includes the steps of heating and oxidizing the surface of a steel sheet having a predetermined chemical component composition in an oxidizing zone; reduction-annealing the steel sheet in a reducing zone; and subsequently dipping the steel sheet in a Zn plating bath. From the viewpoint of productivity, the oxidation-reduction galvanizing method is preferably carried out in a continuous hot-dip galvanizing line (CGL).

When the oxidation-reduction galvanizing method is applied, it is important to carry out rapid oxidation by applying flames directly to the base steel sheet in an oxidation furnace (OF) and to control the degree (magnitude) of oxidation in the oxidation process.

Galvanization may also be carried out according to a representative common technique of using a continuous hot-dip galvanizing line (CGL) in a no-oxygen furnace (non-oxidizing furnace) (NOF) under a weakly oxidizing atmosphere whose air-fuel ratio is controlled to be low, by carrying out oxidation while adjusting the air-fuel ratio. According to this technique, however, the oxidation rate is low and the steel sheet resides in such an oxidizing atmosphere over a long period of time, during which the oxidation of silicon and manganese also proceeds. Additionally, it is difficult to control the degrees of oxidation of the respective elements. Further, it is difficult to ensure a sufficient degree of oxidation of iron necessary for controlling the aluminum content in the galvanized layer within the preferred range.

The rapid oxidation, in which flames are directly applied to the steel sheet in an oxidation furnace (OF), is preferably carried out according to a direct fired system using burners having nozzles facing the top and bottom of the steel sheet, and more preferably using slit burners extending in a width direction of the steel sheet. In this process, the growth rate of an iron-based oxide layer (the rate of increase in layer thickness per one second) when the steel sheet passes through an oxidation domain of the flames is preferably controlled to be 200 to 2000 angstroms per second. If the growth rate is less than 200 angstroms per second, an iron-based oxide layer having a sufficient thickness may not be rapidly formed. In contrast, if the growth rate exceeds 2000 angstroms per second, it may be difficult to control the thickness of the iron-based oxide layer and to allow the iron-based oxide layer to have a uniform thickness.

According to the present invention, the output of the oxidation furnace and the steel sheet temperature at the outlet of the oxidation furnace are controlled so as to carry out galvanization according to the oxidation-reduction galvanizing method and to avoid excessive oxidation and resulting excessive silicon content during oxidation. The condition (1) is satisfied by this procedure. The degree of oxidation increases with an increasing output of the oxidation furnace. Even when the output of the oxidation furnace is constant, the degree of oxidation increases with an elevating steel sheet temperature at the outlet of the oxidation furnace. In addition, according to the present invention, oxidation is conducted not in a no-oxygen furnace but in an oxidation furnace so as to prevent the Mn/Si ratio from being excessively large. In other words, oxidation is conducted through rapid oxidation according to the present invention. The condition (2) is satisfied by this procedure.

As used in Table 2, the term "(Firing in OF) absent" means that oxidation by direct application of flames from burners is not conducted in an oxidation furnace. Also in this case, however, the steel sheet passes through an oxidation furnace in which no burner is fired. Accordingly, also in the case of "(Firing in OF) absent", the terms "temperature at inlet of OF" and "temperature at outlet of OF" refer to temperatures measured at the same positions with the same thermometer as in the case of "(Firing in OF) present" in which burners in the oxidation furnace are fired.

When the steel sheet is oxidized by the application of flames from burners, the growth rate of the iron-based oxide layer can be increased by feeding oxygen and/or steam (water vapor) to the combustion air of the burners according to necessity. However, when excessive oxygen and/or steam is fed, advantages thereof may be saturated and the utilities (facilities) therefor are expensive, and oxygen and steam are preferably fed at flow rates of 20 percent by volume or less and 40 percent by volume or less, respectively, relative to the volume of the combustion air.

The annealing after oxidation is preferably carried out in a nitrogen-hydrogen ($N_2$—$H_2$) atmosphere containing 25 percent by volume or more of $H_2$ and having a dew point of −20° C. or lower at a temperature of the steel sheet of 750° C. or higher, so as to reduce the iron-based oxide film.

The GA steel sheets according to the present invention show satisfactory phosphatability, ensure satisfactory coating properties such as coating adhesion and corrosion resistance in a subsequent coating process, and are preferably used as materials for automobile bodies.

EXAMPLES

The present invention will be illustrated in further detail with reference to several examples below. It should be noted, however, that these examples are never intended to limit the scope of the present invention; various alternations and modifications may be made without departing from the scope and spirit of the present invention; and they are included within the technical scope of the present invention.

Example 1

A series of GA steel sheets was produced in a continuous hot-dip galvanizing line (CGL) including an oxidation furnace (OF) arranged between a no-oxygen furnace (NOF) and an annealing furnace. They were prepared by using base steel sheets (sheet thickness: each 1.4 mm) containing chemical components given in following Table 1 under conditions mentioned below.

TABLE 1

| Steel | Chemical component composition*1 (percent by mass) | | | | | | | |
|---|---|---|---|---|---|---|---|---|
| type | C | Si | Mn | P | S | Al | Cr | N |
| A | 0.13 | 1.80 | 2.2 | 0.013 | 0.001 | 0.06 | — | 0.004 |
| B | 0.07 | 1.20 | 2.3 | 0.011 | 0.001 | 0.05 | 0.07 | 0.006 |

*1Remainder: iron and inevitable impurities

[Production of Hot-Dip Galvannealed Steel Sheets (GA Steel Sheets)]

(1) Line Speed: 40 m/min.

(2) No-Oxygen Furnace (NOF)

With direct-flame burners

Air-fuel ratio: 0.95 (when oxidation was conducted in not an oxidation furnace but a no-oxygen furnace, the air-fuel ratio was set at 1.20)

Residence time: 28 seconds (3) Oxidation Furnace (OF)

Burner type: direct-flame burners

Number of burners: Each two burners facing the front and back sides of the steel sheet (total of four burners) were arranged in a travel direction of the steel sheet, which burners apply flames perpendicularly to the steel sheet.

Length of furnace: 4 m

Air-fuel ratio: 1.42

Feeding of oxygen and/or steam: None

Output of burners in the oxidation furnace: controlled at two levels, i.e., maximum (MAX) (coke oven gas (COG) flow rate: 50 $Nm^3$/h/nozzle) and 60% of MAX (COG flow rate: 30 $Nm^3$/h/nozzle) [wherein "$NNm^3$" means "normal cubic meter" and refers to a volume at 298K and $10^5$ Pa]

Temperature of steel sheet at an outlet of the oxidation furnace: 710° C. to 810° C.

Residence time in the oxidation furnace: 6 seconds

Oxidation rate: minimum (MIN) (the minimum oxidation rate is an oxidation rate of 1.8%-Si steel at an oxidation rate at an output of the burners in the oxidation furnace of 60% and a steel sheet temperature at the outlet of the oxidation furnace of 770° C. and corresponds to about 500 angstroms per second)

Conditions in the oxidation furnace are shown in following Table 2.

TABLE 2

| | | Steel sheet | | Oxidation | | | |
|---|---|---|---|---|---|---|---|
| GA steel sheet number | Steel type | Si concentration (% by mass) | Mn concentration (% by mass) | Firing in OF | OF output (COG flow rate: $Nm^3$/h/nozzle) | Temperature of steel sheet at inlet of OF (° C.)*2 | Temperature of steel sheet at outlet of OF (° C.)*3 |
| 1 | A | 1.8 | 2.2 | present | 50 | 680 | 740 |
| 2 | A | 1.8 | 2.2 | present | 50 | 700 | 760 |
| 3 | A | 1.8 | 2.2 | present | 50 | 735 | 790 |
| 4 | A | 1.8 | 2.2 | present | 50 | 735 | 790 |
| 5 | A | 1.8 | 2.2 | present | 50 | 745 | 800 |
| 6 | A | 1.8 | 2.2 | present | 30 | 735 | 770 |
| 7 | A | 1.8 | 2.2 | present | 30 | 735 | 770 |
| 8 | A | 1.8 | 2.2 | present | 30 | 735 | 770 |
| 9 | A | 1.8 | 2.2 | present | 30 | 760 | 790 |
| 10 | A | 1.8 | 2.2 | present | 30 | 760 | 790 |
| 11 | A | 1.8 | 2.2 | present | 30 | 760 | 790 |
| 12 | A | 1.8 | 2.2 | present | 30 | 780 | 810 |
| 13 | A | 1.8 | 2.2 | absent | — | 800 | 800 |
| 14 | A | 1.8 | 2.2 | absent | — | 800 | 800 |
| 15 | A | 1.8 | 2.2 | absent | — | 800 | 800 |
| 16 | A | 1.8 | 2.2 | absent | — | 860 | 860 |
| 17 | B | 1.2 | 2.3 | present | 50 | 640 | 710 |
| 18 | B | 1.2 | 2.3 | present | 50 | 650 | 720 |
| 19 | B | 1.2 | 2.3 | present | 30 | 670 | 710 |
| 20 | B | 1.2 | 2.3 | present | 30 | 655 | 700 |

TABLE 2-continued

| GA steel sheet number | Steel type | Steel sheet: Si concentration (% by mass) | Steel sheet: Mn concentration (% by mass) | Oxidation: Firing in OF | Oxidation: OF output (COG flow rate: $Nm^3/h/nozzle$) | Oxidation: Temperature of steel sheet at inlet of OF (° C.)*2 | Oxidation: Temperature of steel sheet at outlet of OF (° C.)*3 |
|---|---|---|---|---|---|---|---|
| 21 | B | 1.2 | 2.3 | absent | — | 790 | 790 |
| 22 | A | 1.8 | 2.2 | present | 30 | 795 | 820 |

*2The temperature of the steel sheet delivered from the no-oxygen furnace but before fed into the oxidation furnace was measured with a radiation thermometer.
*3The temperature of the steel sheet delivered from the oxidation furnace was measured with a radiation thermometer.

(4) Reduction Furnace

Atmosphere: $N_2$ with 15% by volume $H_2$

Dew point: −30° C.

Temperature of steel sheet: 800° C. to 860° C.

Residence time: 50 seconds (5) Galvanization

Bath composition: Zn-0.10% by mass Al (Al: effective concentration)

Bath temperature: 460° C.

Temperature of entering steel sheet: 460° C.

Residence time: 3.8 seconds dissolving the galvanized layer in hydrochloric acid and calculating the difference between the mass of the layer before and after dissolution; and the solution of the galvanized layer in hydrochloric acid was analyzed through inductively coupled plasma spectrometry (ICP) to determine the concentrations of Si, Mn, and Al in the galvanized layer. The measurements are shown in Table 3 below.

In Table 3, the terms "Si concentration" and "Mn concentration" mean "the concentration of silicon present as an oxide" and "the concentration of manganese present as an oxide", respectively.

TABLE 3

| GA steel sheet number | Steel type | Galvanized layer: Amount of deposit ($g/m^2$) | Fe content (%) | Al concentration (% by mass) | Si concentration (% by mass) | Mn concentration (% by mass) | Mn concentration/Si concentration |
|---|---|---|---|---|---|---|---|
| 1 | A | 56.4 | 8.2 | 0.39 | 0.11 | 0.25 | 2.3 |
| 2 | A | 54.8 | 8.7 | 0.45 | 0.21 | 0.33 | 1.5 |
| 3 | A | 38.9 | 12.1 | 0.54 | 0.32 | 0.47 | 1.5 |
| 4 | A | 36.8 | 11.4 | 0.64 | 0.32 | 0.49 | 1.5 |
| 5 | A | 36.4 | 15.3 | 0.56 | 0.35 | 0.61 | 1.7 |
| 6 | A | 51.2 | 9.3 | 0.39 | 0.12 | 0.30 | 2.5 |
| 7 | A | 37.5 | 10.1 | 0.43 | 0.13 | 0.36 | 2.8 |
| 8 | A | 32.5 | 13.1 | 0.37 | 0.14 | 0.41 | 2.8 |
| 9 | A | 56.2 | 11.6 | 0.48 | 0.18 | 0.28 | 1.6 |
| 10 | A | 45.1 | 12.8 | 0.56 | 0.20 | 0.41 | 2.1 |
| 11 | A | 49.0 | 14.1 | 0.51 | 0.23 | 0.40 | 1.7 |
| 12 | A | 41.6 | 13.7 | 0.57 | 0.27 | 0.67 | 2.5 |
| 13 | A | 36.4 | 9.1 | 0.41 | 0.12 | 0.39 | 3.3 |
| 14 | A | 57.7 | 10.4 | 0.45 | 0.11 | 0.39 | 3.5 |
| 15 | A | 39.3 | 12.4 | 0.40 | 0.13 | 0.48 | 3.7 |
| 16 | A | 37.9 | 10.8 | 0.50 | 0.21 | 0.66 | 3.1 |
| 17 | B | 51.4 | 7.5 | 0.52 | 0.22 | 0.51 | 2.3 |
| 18 | B | 44.2 | 10.7 | 0.55 | 0.29 | 0.71 | 2.5 |
| 19 | B | 55.4 | 11.9 | 0.45 | 0.12 | 0.27 | 2.2 |
| 20 | B | 45.4 | 11.6 | 0.39 | 0.08 | 0.21 | 2.9 |
| 21 | B | 38.1 | 11.4 | 0.41 | 0.13 | 0.50 | 3.8 |
| 22 | A | 49.9 | 12.0 | 0.56 | 0.13 | 0.40 | 3.1 |

(6) Alloying Furnace

Direct flame heating type

Temperature of alloying furnace: 800° C. to 1100° C.

Temperature of steel sheet for alloying: 480° C. to 580° C.

Residence time: 20 seconds

On the resulting GA steel sheets, the cross section of the galvanized layer was observed through electron probe microanalysis (EPMA) to determine whether or not the galvanized layer contains oxides containing Si and/or Mn (silicon oxides, manganese oxides, and multi-component oxides containing silicon and manganese) and whether or not the galvanized layer contains Si and/or Mn other than those present as oxides. The amount of deposit was determined by Independently, the phosphatability was evaluated according to the following procedure. Initially, a rust-preventive agent "NOX-RUST 550HN" (supplied by Parker Industries, Inc.) was applied to the produced GA steel sheets to give steel sheet test pieces. Each of the steel sheet test pieces was degreased by immersing in a 2% aqueous solution of an alkaline degreasing agent "SURF CLEANER SD400A" (supplied by Nippon Paint Co., Ltd.) warmed at 40° C. for 2 minutes, rinsed with water, subjected to surface control, and immersed in a phosphating solution "SURF DINE DP4000" (supplied by Nippon Paint Co., Ltd.) warmed at 45° C. to form a zinc phosphate film. The crystal size and the plane ratio of the zinc phosphate crystal (020) plane of the formed zinc phosphate film were measured, and the soundness (quality) of the phosphate film was evaluated.

[Method for Evaluating Crystal Size]

The crystal size was measured by observing the surface of a sample with a scanning electronic microscope (SEM) at a magnification of 1000 times, averaging the crystal sizes of five crystals having larger sizes in a view field, repeating this procedure in a total of five view fields, and averaging measurements in the five view fields to give a crystal size. The measured crystal size was evaluated according to the following criteria:

Criteria

Good: (crystal size)≤20 μm

Fair: 20 μm<(crystal size)≤25 μm

Poor: 25 μm<(crystal size)

The plane ratio was measured as a ratio of the X-ray diffracted intensity of the (020) plane to the X-ray diffracted intensities of the (151) plane and the (241) plane of the zinc phosphate crystal as determined through X-ray diffractometry using a copper (Cu) target. The measured plane ratio was evaluated according to the following criteria:

Criteria

Good:(plane ratio)≤4

Fair: 4<(plane ratio)≤5

Poor: 5<(plane ratio)

The results are shown in Table 4 below. These results demonstrate that samples satisfying the requirements as specified in the present invention (GA steel sheet Nos. 1, 2, 6-11, 17, 19, and 20) have satisfactory phosphatability, whereas samples not satisfying the requirements as specified in the present invention (GA steel sheet Nos. 3-5, 12-16, 18, 21, and 22) have poor phosphatability.

TABLE 4

| GA steel sheet number | Steel type | Phosphatability | | | |
|---|---|---|---|---|---|
| | | Plane Ratio | | Size | |
| 1 | A | 2.4 | Good | 13.1 | Good |
| 2 | A | 3.1 | Good | 15.6 | Good |
| 3 | A | 2.4 | Good | 20.7 | Fair |
| 4 | A | 1.6 | Good | 27.5 | Poor |
| 5 | A | 1.8 | Good | 25.0 | Poor |
| 6 | A | 3.7 | Good | 14.8 | Good |
| 7 | A | 2.5 | Good | 11.4 | Good |
| 8 | A | 3.6 | Good | 9.7 | Good |
| 9 | A | 2.7 | Good | 15.6 | Good |
| 10 | A | 3.2 | Good | 14.8 | Good |
| 11 | A | 2.6 | Good | 15.6 | Good |
| 12 | A | 2.0 | Good | 21.6 | Fair |
| 13 | A | 4.4 | Fair | 12.2 | Good |
| 14 | A | 5.8 | Poor | 17.3 | Good |
| 15 | A | 7.1 | Poor | 16.5 | Good |
| 16 | A | 5.0 | Poor | 12.2 | Good |
| 17 | B | 2.7 | Good | 19.0 | Good |
| 18 | B | 3.4 | Good | 24.1 | Fair |
| 19 | B | 2.1 | Good | 13.9 | Good |
| 20 | B | 3.5 | Good | 14.0 | Good |
| 21 | B | 5.5 | Poor | 17.3 | Good |
| 22 | A | 4.9 | Fair | 16.9 | Good |

The invention claimed is:

1. A high-strength hot-dip galvannealed steel sheet with superior phosphatability, comprising a base steel sheet and, arranged on at least one side thereof, an iron-zinc (Fe—Zn) alloyed galvanized layer, wherein the base steel sheet comprises, as a percent by mass, 0.03% to 0.3% of carbon (C), 0.5% to 3.0% of silicon (Si), and 0.5% to 3.5% of manganese (Mn), with the remainder including iron and inevitable impurities, and wherein the Fe—Zn alloyed galvanized layer has a concentration of silicon present as an oxide of [Si] (percent by mass) and a concentration of manganese present as an oxide of [Mn] (percent by mass), and the parameters [Si] and [Mn] satisfy the following conditions (1), (2) and (3):

$$[Si] \leq 0.25 \quad (1)$$

$$[Mn]/[Si] \leq 3.0 \quad (2)$$

$$[Mn] \geq 0.21 \quad (3).$$

2. The high-strength hot-dip galvannealed steel sheet according to claim 1, wherein the Fe—Zn alloyed galvanized layer has an aluminum (Al) content of 0.35% or more, as a percent by mass.

3. The high-strength hot-dip galvannealed steel sheet according to claim 2, wherein the Al content in the Fe—Zn alloyed galvanized layer is from 0.40% to 0.8%, as a percent by mass.

4. The high-strength hot-dip galvannealed steel sheet according to claim 2, wherein the Al content in the Fe—Zn alloyed galvanized layer is from 0.45% to 0.7%, as a percent by mass.

5. The high-strength hot-dip galvannealed steel sheet according to claim 1, wherein the Fe—Zn alloyed galvanized layer has an iron (Fe) concentration of from 7% to 15%, as a percent by mass.

6. The high-strength hot-dip galvannealed steel sheet according to claim 1, wherein the base steel sheet further contains 0.001% to 1.0% of chromium (Cr), as a percent by mass.

7. The high-strength hot-dip galvannealed steel sheet according to claim 1, wherein the base steel sheet further contains 0.005% to 3.0% of aluminum (Al), as a percent by mass.

8. The high-strength hot-dip galvannealed steel sheet according to claim 1, wherein the C content in the base steel sheet is 0.05% to 0.25%, as a percent by mass.

9. The high-strength hot-dip galvannealed steel sheet according to claim 1, wherein the Si content in the base steel sheet is 0.7% to 2.5%, as a percent by mass.

10. The high-strength hot-dip galvannealed steel sheet according to claim 1, wherein the Mn content in the base steel sheet is 1.0% to 3.0%, as a percent by mass.

* * * * *